United States Patent [19]

Putnam

[11] Patent Number: 4,624,445

[45] Date of Patent: Nov. 25, 1986

[54] LOCKOUT VALVE

[75] Inventor: Richard C. Putnam, Nickerson, Kans.

[73] Assignee: The Cessna Aircraft Company, Wichita, Kans.

[21] Appl. No.: 771,681

[22] Filed: Sep. 3, 1985

[51] Int. Cl.[4] ..... F15B 13/01; F15B 13/04

[52] U.S. Cl. ..... 251/63.4; 91/420; 91/447; 137/522

[58] Field of Search ..... 91/420, 445, 447; 251/63.4; 137/522

[56] References Cited

U.S. PATENT DOCUMENTS 3,247,867 4/1966 Martin ..... 91/420 X
3,613,508 10/1971 Krehbiel ..... 91/420
4,545,287 10/1985 Jackson ..... 91/420

FOREIGN PATENT DOCUMENTS 3013083 10/1981 Fed. Rep. of Germany ..... 91/420

*Primary Examiner*—Gerald A. Michalsky
*Attorney, Agent, or Firm*—Edward L. Brown, Jr.

[57] ABSTRACT

The invention is a lockout valve used in a hydraulic circuit to prevent leakage in a static condition; the lockout valve does not require outside force to hold the lockout open once flow across the lockout is established due to the positioning of an orifice ring around the poppet upstream of the poppet seat with the closing area acting on the poppet in conjunction with a spring which senses the pressure downstream of the orifice ring so that when there is sufficient flow across the orifice ring, the force created by the opening area on the poppet, which is located upstream of the orifice ring, will exceed the combined force of the spring and the closing area so that the lockout valve will remain open without an outside force so long as sufficient flow is maintained across the poppet.

7 Claims, 4 Drawing Figures

LOCKOUT VALVE

BACKGROUND OF THE INVENTION

The invention relates to "lockout" valves which have been used in the mobile hydraulics industry for decades. The only purpose for lockout valves is to eliminate leakage within the hydraulic circuit when the circuit is holding up a static load. A "lockout" is basically a zero-leakage check valve placed in the return line of a system which blocks the return flow from a loaded cylinder to tank except when held open. An example of a "lockout" valve is shown in U.S. Pat. No. 3,613,508, wherein one "lockout" is located in each motor port of a typical hydraulic circuit.

The control and direction of oil in hydraulic circuits is basically controlled by spool-type directional control valves which comprise a slidable spool in a valve body which has various grooves and lands in the spool and corresponding cavities in the valve body to direct and drain the oil to various functions. Because of the relatively loose tolerance in spool valves required to allow them to slide in their bores without binding, the amount of leakage across the spool becomes unacceptable in certain applications. For example, in a circuit which elevates a crane boom, it is unacceptable to have the boom under load in a static condition to move downward or settle due to leakage across the directional control valve spool.

A typical lockout under load is held shut by the force of the load and therefore requires a separate actuating force greater than the load to open the lockout and allow the system to move. Typically this actuating force is provided by pressure in the opposite motor port which actuates a pin to force the lockout open and allow flow to commence in the circuit. The necessity of working pressure to hold the lockout open during operation has limited the application of lockouts to single-acting cylinders, lightly loaded double-acting cylinders or severely orificed double-acting functions. What typically happens when lockouts malfunction is that the pressure necessary in the opposite motor port to hold the lockout open is momentarily lost, due to the system's pump being unable to keep up with the movement in the cylinder under heavy load, thereby causing the lockout to momentarily close due to loss of pressure on the opposite side of the circuit causing the lockout to chatter due to its rapid opening and closing which takes place each time the pump catches up with the load.

SUMMARY OF THE INVENTION

The lockout design of the present invention does not require inlet pressure to hold the lockout open once a flow across the lockout is established. This is accomplished by locating a variable orifice on the surface of the lockout poppet in the form of a stationary orifice ring which receives a metering diameter on the lockout poppet which varies its annular-shaped orifice opening from a very small flow path with the lockout in the fully closed position to a much enlarged orifice at the fully open position. The closing area acting on a poppet in conjunction with the spring force senses the pressure downstream of the variable orifice so that when there is sufficient flow across the orifice ring, the force created by the opening area on the poppet will exceed the combined force of the spring and the closing area so that the lockout valve will remain open without outside force from the actuating pin and the loss of pressure in the opposite motor port will not affect the lockout's function.

It is therefore the principal object of the present invention to provide a lockout valve which remains open once adequate flow is established across the lockout without any outside forces.

Another object of the present invention is to provide a lockout valve which does not depend upon pressure from a secondary source to remain open once flow is established across the lockout.

A further object of the present invention is to provide a lockout valve which does not chatter without the addition of added valving on the main directional control valve spool.

A further object of the present invention is to provide a lockout valve designed without close concentricity tolerances between the poppet and its seat.

Other objects and advantages of the present invention are described in or will become apparent from the following detailed description and accompanying drawings of the preferred embodiment.

DESCRIPTION OF THE PREFERRED EMBODIMENT OF THE DRAWING

Figure 1:
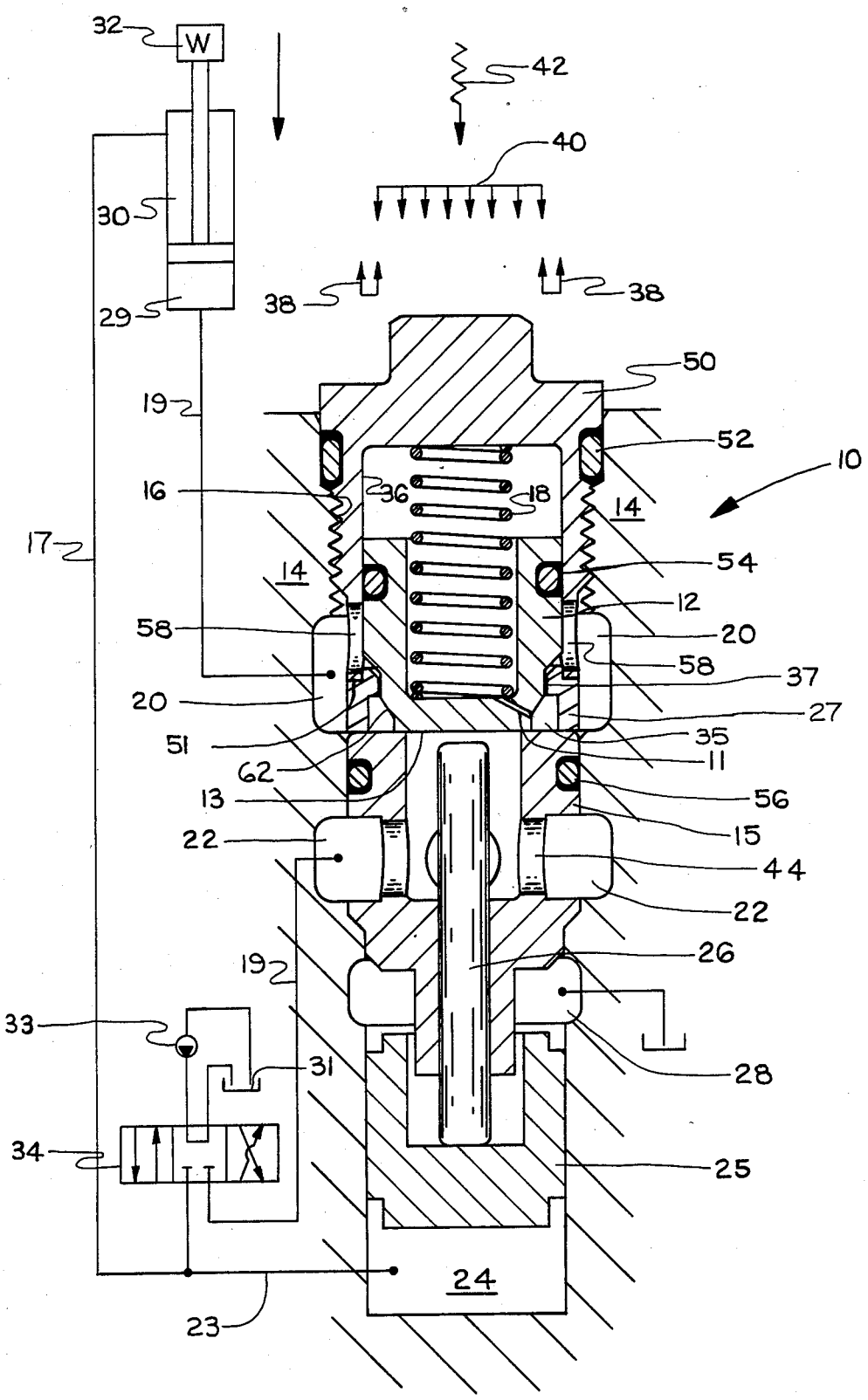
FIG. 1 is a longitudinal section through the lockout valve of the present invention with the remaining portions of the hydraulic system symbolically illustrated.

With reference to FIG. 1 of the drawing, the lockout valve of the present invention is generally referred to by reference numeral 10. Lockout 10 is positioned in a hydraulic circuit between a directional control valve 34 and a double-acting cylinder 30. Directional control valve 34 is a conventional four-way three-position spool type valve which is manually shifted to either of its power positions or to its neutral position, as illustrated in the drawing. The control valve 34 is supplied by pressurized fluid from a conventional pump 33 of any type and a return flow path to reservoir 31. Control valve 34 supplies hydraulic pressure to either the rod or cap end of a double-acting cylinder 30 which in turn lifts or lowers a load 32 exerting a force in the downward direction, as indicated by the arrow. A typical application for this hydraulic circuit would be the lifting of the boom on some type of mobile crane which was used for lifting and holding heavy gravity loads.

Of the two lines 17 and 19 connecting cylinder 30 with control valve 34, lockout valve 10 is shown in only line 19. A second lockout valve 10 could likewise be positioned in line 17 if the present hydraulic circuit was utilized where a gravity load would be held by the rod end of cylinder 30.

Flow of hydraulic fluid through the lockout 10 from control valve 34 to the cylinder 30 is basically unrestricted since pump pressure in line 19 is exerted on the bottom surface 13 of the poppet causing it to move against spring 18 and allow flow to the cap end 19 of the cylinder via cavity 35, tapered surface 62, lateral opening 58 and pressure inlet chamber 20.

Flow in the reverse direction in line 19 from the cap end 29 of the cylinder to the control valve 34 is blocked by lockout 10 acting basically as a check valve with poppet 12 sealing against valve seat 15 with pressure caused by load 32 acting on the backside of the poppet through drilled passage 11. The poppet 12 remains seated until the pump pressure in chamber 24 (via valve 34 and line 23) builds sufficiently to overcome the closing force of the load and open the poppet 12. The area of plunger 25 being greater than the area of surface 13 allows the plunger force to open the poppet regardless of the load.

Lockout valve 10 is separately shown in FIG. 1 from directional control valve 34, however, the lockout valve can be incorporated in the same valve body with directional control valve 34 rather than being remotely located as symbolically illustrated in FIG. 1.

Figure 2:
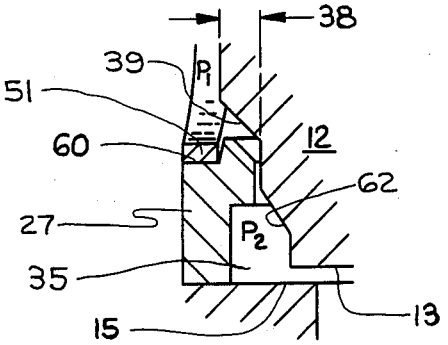
FIG. 2 is a fragmentary sectional view with the lockout poppet partially open and allowing a minimum flow across the valve.
Figure 3:
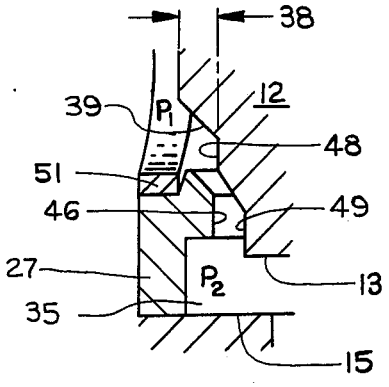
FIG. 3 is a similar view to FIG. 2 with the poppet positioned in an increased flow position.

Lockout valve 10 comprises a valve body 14 having a bore 16 therein which receives the various components of the valve. Intersecting bore 16 is a pressure inlet chamber 20 and an outlet chamber 22. Located in a stationary position between the last mentioned inlet and outlet chambers is a valve seat 15 which is engaged by poppet 12 in its sealing position, as illustrated in FIG. 1. Valve poppet member 12 is slidably positioned in a bore 36 which is in turn located within a removable plug 50. Bore 36 contains a spring 18 and also acts as a servo chamber for forcing the poppet towards its closed position. Located approximate the lower end of poppet 12 is a reduced diameter section 48 on the poppet which passes through orifice ring 27 with a loose fitting tolerance allowing low levels of flow between the reduced diameter section 48 of the poppet and the inside diameter 46 on the ring also referred to as annular space 37. Ring 27 is held in position within the valve by plug end 51 which engages a circumferential groove 60 in ring 27, as best seen in FIGS. 1 and 2. Poppet 12 includes a second reduced diameter section 49, as best seen in FIG. 3, separated from the reduced diameter section 48 by a tapered section 62. Passing through tapered section 62 is a drilled passage 11 which allows the pressure in cavity 35 to be sensed in the bore 36. The pressure sensed in bore 36 acts on the backside of poppet 12 and is hereinafter referred to as a closing area 40, which is symbolically illustrated by arrows 40 in FIG. 1. On the poppet 12 located between the first reduced diameter section 48 and the outside diameter of the poppet, is a second tapered section 39, as best seen in FIG. 2, which provides an opening area 38 which when exposed to pressure $P_1$ attempts to open poppet 12. The sealing surface 13 on the poppet is totally flat and lies in a plane normal to the axis of poppet movement. With this type of flat seat 15 and sealing surface 13, there is no concentricity tolerances necessary between the poppet and the seat. The poppet sealing surface 13 could also be conical or spherical in shape, as is well known in the prior art.

Located at the lower end of valve bore 16 is a servo piston 25 sliding in a servo chamber 24 which is exposed to pump pressure when control valve 34 is shifted to the right to its straight through position. Servo piston 25 in turn contacts actuating pin 26 which initially opens poppet 12 to allow flow from the cap end 29 of the cylinder to drain via control valve 34. The upper end of servo piston 25 moves into drain cavity 28 so that the piston can freely move in an upward direction.

Lateral openings 44 in valve seat 15 allow fluid flow between chamber 22 and the open center passage of seat 15. Lateral openings 58 in plug 50 likewise allow flow from pressure inlet chamber 20 to flow between orifice ring 27 and the poppet 12. O-rings 52, 54 and 56 in the lockout valve are conventional o-ring seals preventing leakage between the adjacent parts.

Located in the flow path across lockout valve 10 is a variable orifice in the form of orifice ring 27 which receives the end of poppet 12 in certain positions. The orifice is a ring-shaped annular space 37 which is smallest in its FIG. 4 position and largest when pin 26 lifts the poppet 12 completely above ring 27 (not shown in the drawing). The FIG. 3 position of the poppet is a self-sustaining partially open position when there is no force from pin 26 which holds the poppet open.

OPERATION

The purpose of lockout valve 10 is to prevent any leakage from the cap end 29 of the cylinder 30 which bears a heavy gravity load 32 from reaching reservoir 31 with directional control valve 34 in its neutral flow-blocking position, as illustrated in FIG. 1. While return line 19 entering control valve 34 is shown blocked off, it is well known in the art of spool type control valves that there is a certain amount of leakage across the spool which is unacceptable in certain applications.

Figure 4:
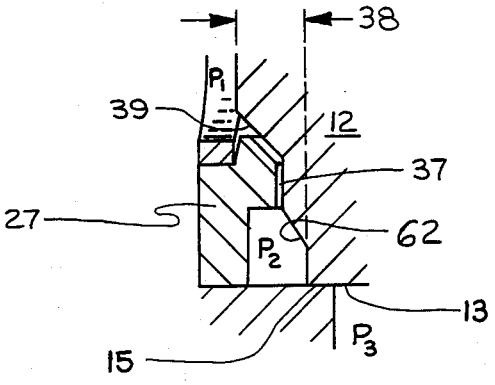
FIG. 4 is a similar view to FIG. 2 with the poppet in the fully closed position.

When a heavy load 32 is left on the hydraulic system even though the pump 33 is shut down and the directional control valve is neutrally positioned, there is a substantial pressure developed in the cap end 29 of the cylinder. This load-induced static pressure is sealed off by the poppet at sealing surface 13 where it engages seat 15, as seen in FIG. 4. Since there is a small annular space 37 between orifice ring 27 and poppet 12, the load pressure in inlet chamber 20 is equalized on the backside of poppet 12 in servo chamber 36 via drilled passage 11. This area of pressure 40 (see FIG. 1) acting on the backside of poppet 12 forces the poppet against its seat 15 in conjunction with the closing force created by spring 18. On the opposite side of poppet 12 the same load pressure in chamber 20 acts on tapered sections 39 and 62 urging the poppet 12 toward the open position. The net pressure force on poppet 12, in its FIG. 4 closed position, is a closing force due to the spring 18 and the closing area 40 being greater than the opening area 38. Therefore to initially open the poppet 12, the outside force from pin 26 must be applied to overcome the closing force in servo chamber 36 exerted by load 32.

To lower load 32, directional control valve 34 is shifted in a rightwardly direction, as viewed in FIG. 1, connecting pump pressure to lines 17 and 23, while opening line 19 to reservoir 31. The pump pressure in line 17 acting on the rod end of cylinder 30 attempts to lower the load 32, however, there is no movement since the poppet 12 is blocking any return flow from the cap end 29 of the cylinder. Pressure from pump 33 is also felt in servo chamber 24 via the branch line 23, and due to the large area of piston 25 the force exerted on poppet 12 through pin 26 is adequate to overcome the load pressure applied in servo chamber 36.

With poppet 12 partially open, as illustrated in the FIG. 2 position, fluid begins to flow across orifice ring 27 through the annular space 37. With flow across orifice ring 27, there is a pressure drop created on the downstream side of the ring which changes the force balance on poppet 12 since the closing force acting on the poppet is sensing the reduced downstream pressure. Once a sufficient pressure drop is created across orifice ring 27, the opening force on the poppet 12 acting on opening area 38 will exceed the closing force acting on area 40 combined with the spring force so that the poppet 12 will remain in its open position without any additional force from pin 26, as long as there is sufficient flow across orifice ring 27 which, for example, could be 3 GPM.

In a FIG. 4 condition, $P_1$ is equal to $P_2$ since there is no flow across space 37. In a FIG. 3 condition, there is a pressure drop between $P_1$ and $P_2$ but $P_2$ is not necessarily zero, such as a condition where control valve 34 is metering down the load.

Closing of the lockout 10 is accomplished by closing of directional control valve 34 by moving the valve to its neutral flow-blocking position. Once flow is stopped across lockout 10, spring 18 returns poppet 12 to its seat 15 and the lockout is closed. The orifice ring 27 and the particular shape of poppet 12 function as a variable orifice as the poppet 12 opens. However, the surface of the poppet could be modified so that it functioned as a fixed orifice rather than a variable orifice without departing from the basic concepts of the present invention.

The detailed description of the preferred embodiment set forth above is exemplary in nature and is not to be considered as limiting to the scope and spirit of the invention as set forth in the accompanying claims.

Having described the invention with sufficient clarity that those skilled in the art may make and use it, what is claimed as new and desired to be secured by Letters Patent is:

1. A self-sustaining lock-out valve which remains open without outside forces as long as sufficient flow is passing across the valve, comprising:

a valve body having a bore which is intersected by an inlet chamber and an outlet chamber;

a poppet positioned in the bore;

a seat positioned in the bore between the inlet and outlet chamber;

spring means urging the poppet into sealing engagement with the seat;

a pin means located in the bore in contact with the poppet for urging the poppet toward an open position;

servo means for actuating the pin means;

an orifice means on the poppet upstream of the seat;

a closing area on the poppet creating a force which urges the poppet closed sensing the pressure downstream of the orifice means;

an opening area on the poppet creating a force which urges the poppet open, the opening area sensing the pressure upstream of the orifice whereby when there is sufficient flow and pressure drop across the orifice, the force on the opening area exceeds the combined closing area force and the spring force so that the lockout remains open when the force on the pin means drops to zero.

2. A self-sustaining lockout valve as set forth in claim 1 including a lateral passage means in the poppet connecting the closing area on the backside of the poppet with an area on the front side of the poppet downstream of the orifice means whereby the closing force from said closing area varies with the pressure drop across the orifice means.

3. A self-sustaining lockout valve as set forth in claim 1 wherein the orifice means includes an orifice ring positioned in the bore and a first reduced diameter section of the poppet which passes through the orifice ring.

4. A self-sustaining lockout valve as set forth in claim 1 wherein the orifice means includes an orifice ring positioned in the bore and a first reduced diameter section of the poppet which passes through the stationary orifice ring, the opening area on the poppet comprising a tapered section above said first reduced diameter section.

5. A self-sustaining lockout valve as set forth in claim 1 wherein the orifice means includes an orifice ring positioned in the bore and a first reduced diameter section of the poppet which passes through the stationary orifice ring, the opening area on the poppet comprising a tapered section above said first reduced diameter section and a lateral passage in the poppet connecting the closing area on the poppet with an area on the poppet downstream of the orifice means whereby the closing force from said closing area varies with the pressure drop across the orifice.

6. A self-sustaining lockout valve as set forth in claim 1 wherein the contact area between the poppet and seat comprises a flat annular shaped area.

7. A self-sustaining lockout valve as set forth in claim 1 wherein the orifice means is variable and includes an orifice ring positioned in the bore and a first reduced diameter section of the poppet which passes through the orifice ring and a second reduced diameter section of the poppet smaller than the first reduced diameter section positioned just downstream of the first reduced diameter section.

* * * * *